US005217147A

United States Patent [19]

Kaufman

[11] Patent Number: 5,217,147

[45] Date of Patent: Jun. 8, 1993

[54] LIQUID DISPENSER WITH COMPRESSION CHAMBER

[75] Inventor: John G. Kaufman, Burlington, Canada

[73] Assignee: Kaufman Products Inc., Burlington, Canada

[21] Appl. No.: 848,591

[22] Filed: Mar. 9, 1992

[51] Int. Cl.[5] ..... B05D 25/42

[52] U.S. Cl. ..... 222/185; 222/207; 222/478

[58] Field of Search ..... 222/185, 207, 209, 212, 222/457, 478, 479, 442, 464

[56] References Cited

U.S. PATENT DOCUMENTS

| | | | |
|---|---|---|---|
| 3,157,319 | 11/1964 | Schwienbacher | 222/207 |
| 4,324,349 | 4/1982 | Kaufman | 222/207 |
| 4,635,828 | 1/1987 | Kaufman | 222/185 |
| 4,645,097 | 2/1987 | Kaufman | 222/207 |
| 4,930,668 | 6/1990 | Krall | 222/212 |
| 5,033,653 | 7/1991 | Kaufman | 222/185 |
| 5,060,830 | 10/1991 | Krall | 222/207 |

*Primary Examiner*—Andres Kashnikow
*Assistant Examiner*—Philippe Derakshani
*Attorney, Agent, or Firm*—Rogers & Scott

[57] ABSTRACT

A dispenser is provided for liquids, the dispenser having a container and an outlet at a predetermined first level. The pressure in the container can be varied and a reservoir receives liquid from the outlet. A discharge passageway extends upwardly from the first level and terminates at a discharge opening at a second level, and an air relief opening is provided above the first level. The relief opening is no lower than the second level so that liquid displaced from the container flows into the reservoir and out of the passageway while air is trapped in the reservoir above the first level. Consequently any gradual increase in temperature will cause air from the reservoir to be displaced through the air relief opening to minimize the risk of temperature driven dispensing. The passageway is defined by the combination of a cup-shaped base and a sleeve within the base.

3 Claims, 3 Drawing Sheets

LIQUID DISPENSER WITH COMPRESSION CHAMBER

This invention relates to dispensers for liquids and more particularly to dispensers used domestically to store and dispense such varied products as vinegar, hair shampoo, ketchup, etc.

The invention will be described primarily with reference to consumer products used domestically, but does have application to dispensing liquids from larger containers used in commercial establishments.

Smaller quantities of products in liquid form have for many years been packaged in a variety of containers suitable for shipping, displaying, handling and eventual point-of-purchase sale. Historically, the most common container has been the glass bottle which can be made in a variety of shapes and sizes and with different types of closures. More recently, however, glass containers have been displaced to some extent by containers of synthetic plastic materials which can be moulded, blow-moulded and generally formed into a great variety of shapes and sizes. Also, because of the nature of plastics materials, closures for these containers can be of many varied types ranging from simple screw-caps similar to those used with glass bottles, to flip tops and valved openings.

A further development has been the introduction of dispensers into the marketplace resulting in a growing impetus to use these dispensers wherever possible. The major characteristic of a dispenser when compared with a simple container is that a dispenser can be activated in some way to provide some of its contents without the need to remove caps or closures, and in some cases without even lifting up the dispenser. This invention provides an improved dispenser which can take a variety of forms.

There have been a number of approaches to the design of dispensers for domestic liquid products, and they fall into three main groups. Firstly, there is the simple device which allows the dispenser to be lifted and tilted to allow some of the contents to fall under the influence of gravity from the dispenser before the dispenser is again held upright to stop the flow. Dispensers of this type are used as attachments to bottles of liquor to permit a particular volume of liquor to be dispensed with each tilt of the bottle.

A second approach is to provide some mechanical device which, when activated, forces some of the liquid out of the dispenser. An example of this would be trigger dispensers which incorporate a pump actuated by the trigger to force some of the contents out of the dispenser. This requires some manual dexterity as well as the application of some force to do work on the dispenser.

The third type of dispenser involves the use of stored energy. An example of this would be an aerosol which contains a gas under pressure, or in some instances, a stretched bladder containing the contents so that the operation of a valve will allow the energy from the bladder to displace some of the liquid contents out of the dispenser.

Of these three types, the present invention falls into the category of a dispenser which requires the application of a force to displace some of the liquid.

The design of all dispensers must meet numerous criteria which are to some extent conflicting. From the standpoint of appearance on a shelf for sale, it is generally accepted that the overall impression given by the dispenser will affect the sales. If the dispenser matches the image projected by the product, then this seems to have an effect on purchases and on the success of the product. On the other hand, the dispenser is a throw-away item so that the cost of the dispenser must be kept to a minimum in order to be competitive in the marketplace.

This cost consideration is of course dependent on complexity so that the less complex the dispenser the more acceptable it would be in terms of the cost of production. It is therefore a challenge to design a dispenser which is both appealing to the eye when containing a particular product and also inexpensive to manufacture while of course operating adequately once the purchaser has started to use the product.

Once the product is purchased and taken to the consumer's home, there are important considerations for the consumer. Firstly the product must function or be useful in the manner anticipated by the purchaser. However, the dispenser containing the product also comes into play because if it is difficult to use, or unreliable in any way, then it may affect the purchaser's decision whether or not to buy the same product again. Reliability includes a number of possible difficulties, but high on the list would be a dispenser which does not dispense cleanly and which possibly drips or allows liquid to soil the outside of the container between uses. This has led to the development of a large number of valved dispensers having designs of valves which are intended to cut off the flow clearly and without dripping and soiling while there is no doubt that suitable structures have been developed, they do add significantly to the cost of the dispenser. As a result attempts have been made to simplify dispensers by eliminating the valving. Such attempts have resulted in difficulty because once the valve is removed temperature fluctuations can drive the contents out of the dispenser with a resulting tendency for dripping. Also, the actual dispensing is less than adequate in many instances.

Synthetic plastics materials also lend themselves to the manufacture of dispensers which have flexible bodies to allow deformation to apply pressure to the contents. This form of dispenser, while avoiding the use of a trigger, nevertheless continues to need the valve which commonly involves some form of closure which is opened before dispensing and closed after dispensing.

The present inventor taught the use of dispensers which have no moving parts and which satisfy the requirements of clean dispensing with temperature compensation to permit the dispenser to be placed in various locations within a designed temperature range without inadvertent dripping or dispensing caused by these temperature variations. Such structures are taught in U.S. Pat. Nos. 4,324,349, 4,635,828, 4,645,097 and 5,033,653. The dispensers include a reservoir containing some of the liquid to be dispensed and in communication with the main part of the dispenser in the form of a container where the major volume of the liquid is contained. Air is trapped above the liquid in the container under a negative pressure which prevents the liquid flowing through the reservoir and out through a discharge passageway. When pressure is applied to the contents, the negative pressure is overcome so that liquid will flow through the reservoir and out via the passageway. As soon as the pressure is released, a negative pressure is created by the walls returning from a deflected condition to the original condition so that air is sucked back into the passageway and reservoir to set up a condition of equilibrium. As the air is sucked back, liquid is cleaned out from the passageway and some of the air finds its way through the liquid to finish above the liquid in the container and some remains in the reservoir. It is the air in the reservoir which effectively provides the temperature compensation. As temperature increases, the negative pressure above the liquid in the container becomes more resulting in some flow into the reservoir and liquid will consequently rise in the reservoir and displace air out of the passageway.

U.S. Pat. No. 5,033,653 is an improvement over the earlier Kaufman patents in that this patent teaches structures in which the parameters of response rate and temperature compensation are made essentially independent compared with the earlier patents in which the parameters were interrelated.

According to U.S. Pat. No. 5,033,653 a dispenser for liquids is provided having a container for holding liquid at levels above a predetermined level, and including means to vary the pressure in the container. An outlet is provided at a level below the predetermined level and a reservoir is in fluid communication with the container. The reservoir defines an air relief opening to permit pressure changes caused by temperature fluctuations to be equalized with atmospheric pressures and a discharge passageway is provided in fluid communication with the container to lead liquid from the container to the outlet when said means is used to increase the pressure in the container. The present invention is an improvement over that structure and is intended to provide an inexpensive structure which is readily disassembled for refilling or washing.

The invention will be better understood with reference to the drawings and associated description wherein.

Figure 1:
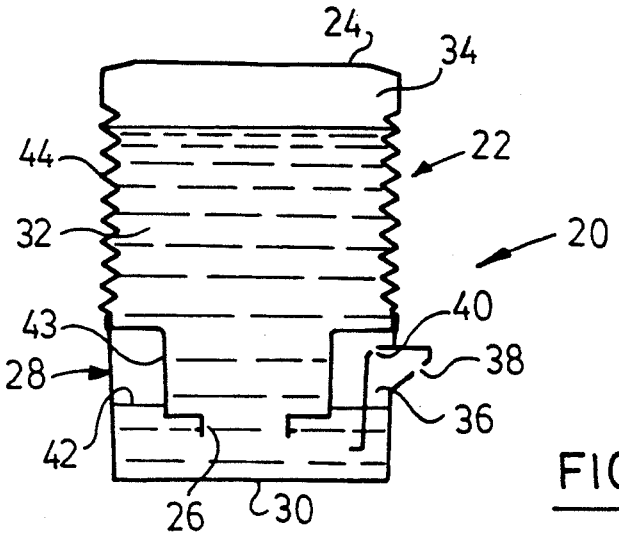
FIGS. 1 to 3 are diagrammatic representations of a dispenser according to the invention in use.

Reference is made first to FIG. 1 which illustrates diagrammatically a dispenser 20 made up of a container 22 with a closed end 24 uppermost and having an opening 26 at the lowermost end within a reservoir 28. The opening 26 is within the reservoir and spaced from a bottom 30 of the reservoir sufficient to permit liquid 32 from the container 22 to flood into the reservoir. The flow will be arrested when the pressure in a space 34 above the liquid 32 reaches a negative pressure sufficient to balance the column of liquid in the dispenser. This is explained in detail in previous Kaufman patents mentioned earlier.

A passageway 36 extends from adjacent the bottom 30 of the reservoir to an outlet 38 where liquid is dispensed. A small hole 40 is provided in the wall of the passageway 36 and communicates with the reservoir for purposes which will be explained.

In the FIG. 1 condition, liquid is in a stable condition and will remain as shown unless the dispenser is activated or is affected by temperature fluctuations. In the event that the temperature increases, then the negative pressure in the space 34 will be affected with the result that a level 42 of liquid in the reservoir will move upwardly. The annular space about a neck 43 of the container 22 is sufficient to accommodate this movement over a wide range of temperature fluctuations. The space above the level 42 in the reservoir is at ambient pressure due to the small hole 40 communicating by the outlet 38 to atmosphere.

Figure 2:
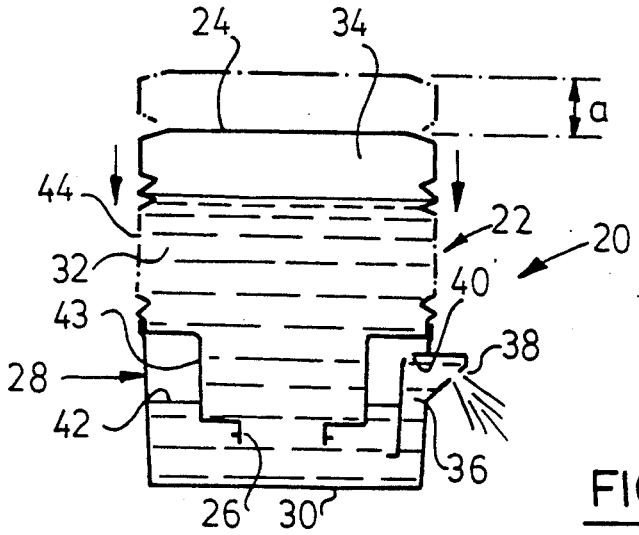

The reservoir shown in FIG. 1 is activated by applying manual pressure to the closed end 24 to deflect a bellows 44 formed in the wall of the container. This affects the pressure in the space 34 and causes the liquid level 42 to rise. This can be seen by comparison of FIGS. 1 and 2 where a deflection "a" has taken place in FIG. 2. Because the hole 40 is small, air from above the level 42 in the reservoir will not move quickly under the effect of the activation of the dispenser because there is an escape for the pressure via the passageway 6. Consequently the change in the pressures within the dispenser is accommodated by liquid moving through the passageway 36 and out through the dispensing outlet 38. There will of course be a pressure differential across the hole 40 but this is insufficient to cause significant flow of air.

Figure 3:
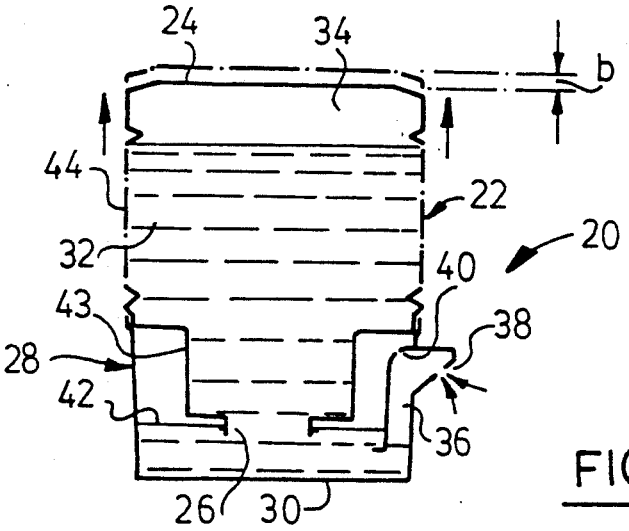

Once the dispensing has taken place, the user releases the end 24 and the resilience in the bellows 44 causes the dispenser to move towards the FIG. 1 position. An intermediate position is shown in FIG. 3. In this case, air will move back into the dispenser and some will find its way through the hole 40 into the space above the level 42. This will tend to assist in having liquid clear the reservoir and return to the container due to the fact that the container is the driving force in having the liquid return. Also, because of the rush of air in the outlet 38, there will be a cleansing effect which will remove liquid from this part of the dispenser and limit the possibility of dripping after dispensing.

The foregoing description of operation of this type of dispenser involves the present invention which is an improvement over the structure shown in U.S. Pat. No. 5,033,653. The improvement structure will now be described with reference to FIGS. 4 and 5.

Figure 4:
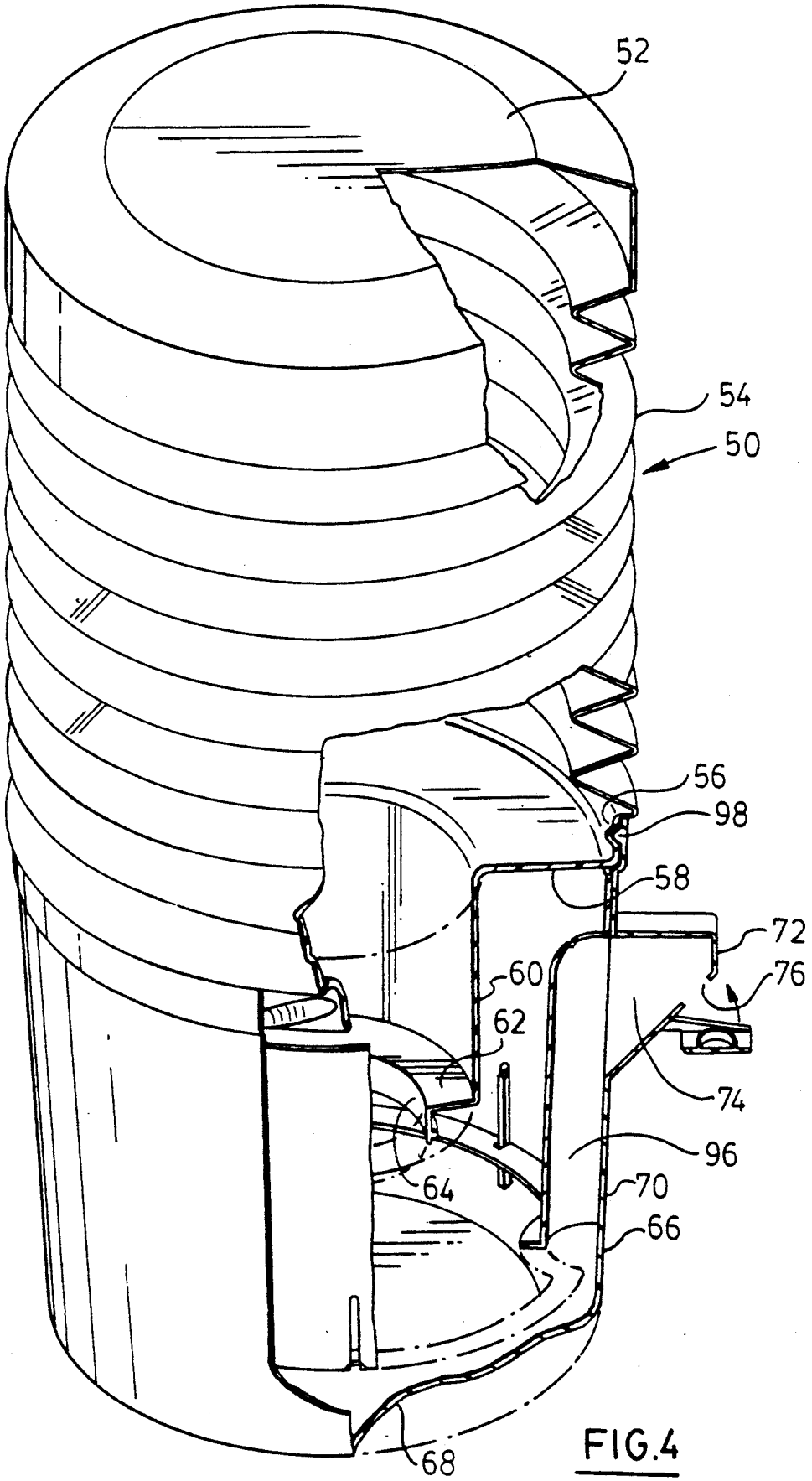
FIG. 4 is an isometric view with portion broken away to show parts of a preferred embodiment of dispenser according to the invention.

As seen in FIG. 4, a container 50 has an end 52 and a wall in the form of a bellows 54. The bellows ends at an annular portion 56 which in turn leads to a radial wall 58 which meets a cylindrical portion 60 terminating in a second radial wall 62, which in turn is connected to a neck 64.

The cylindrical annular portion 56 of the container is connected (by means which will be described) to a cup-shaped base 66 having a bottom 68 and a slightly conical side wall 70. The angle on the side wall is small and in the order of 2 degrees.

The base 66 is moulded to include an outlet structure 72 which projects radially outwards to form a small chamber 74 and outlet opening 76. As can be better seen in FIG. 5, the outlet structure 72 receives a pivoted closure 78 having a cylindrical plug 79 which can engage the opening 76 (FIG. 4) when the closure is pivoted upwardly into engagement with the outlet structure 72. This can be used to close the dispenser for shipment or in general, to contain the contents when the dispenser is moved. In normal use, the closure 78 will simply hang out of the way as shown in FIG. 5.

Figure 5:
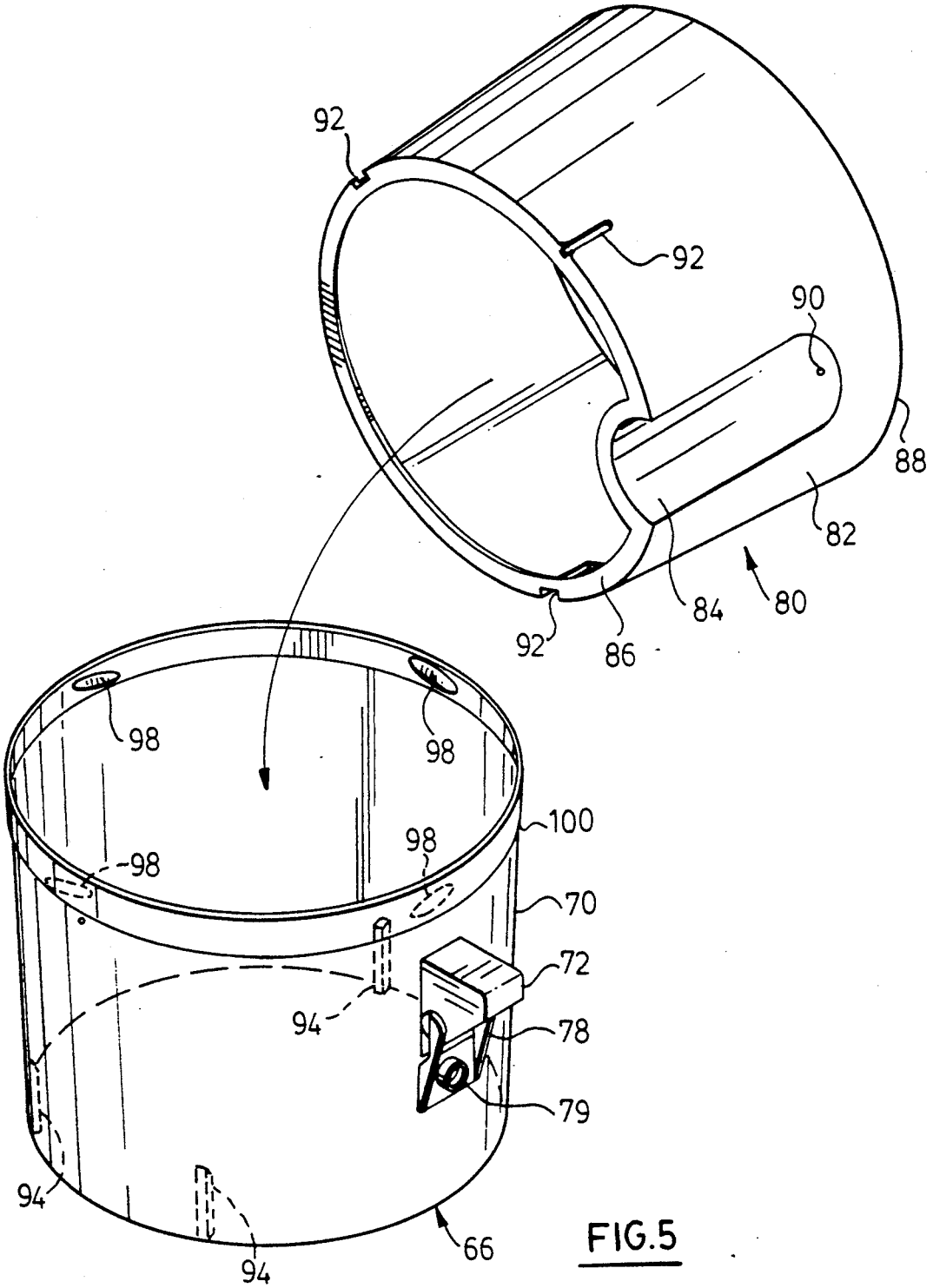
FIG. 5 is an exploded isometric view of parts of the dispenser.

As also shown in FIGS. 4 and 5, within the cup-shaped base 66 is a sleeve 80 which also is generally cylindrical but actually has a small conical shaping to the side wall 82. This is also of the order of 2 degrees to match the similar shaping of the base 66. Consequently when these two parts are engaged, because the outer wall of the sleeve 80 is a close friction fit within the base 66, the fit will cause a seal between the two parts as they engage in face-to-face relationship.

The sleeve 80 is shaped with an external axial recess 84 which extends from a bottom lip 86 towards the top 88 of the sleeve but terminates short of the top. A small hole 90 pierces the sleeve to communicate from within the recess 84 to the inside of the sleeve. Three location slots 92 are provided at the periphery of the sleeve and spaced irregularly so that they will meet location buttresses 94 in the bottom of the base 66 to permit engagement of the sleeve within the base in one position only. This position ensures that the recess 84 is in alignment with the outlet structure 72 as shown in FIG. 4.

The rest of the structure will be described with reference to assembling the dispenser. The closure 78 is a snap fit on the outlet structure 72 and can be assembled first. Then, the sleeve 80 is dropped into the base 66 and moved to bring the alignment slots 92 into engagement with the corresponding buttresses 94 whereupon the sleeve can be pushed into frictional engagement inside the base to form a seal between the two parts except for where the recess 84 is positioned. This recess then combines with the inside surface of the side wall 70 of the base to form a passageway 96 shown in FIG. 4.

The resulting sub-assembly is then attached to the container 50 and to this end, the annular portion 56 of the container is moved into sealing engagement with the base 66 and locked in place by threaded engagement between four inner projections 98 formed on the inner surface of a peripheral ring 100 which forms an integral part of the base 66. These projections engage in corresponding depressions in the container and these depressions angled on a helix so that as the container engages the projections 98 it can be rotated to bring it into tight and firm engagement with the base to seal the container to the base.

An example of how these parts interrelate can be seen in FIG. 4 where one of the projections 98 is engaged in the aforementioned depression in the container 50. Any suitable arrangement of mating parts will be sufficient to cause a seal at this point. It is important to note that the seal is not essential to the operation of the structure although if the seal is very poor, then there would be sufficient leakage to cause problems after several dispensings.

It will now be apparent that the dispenser is extremely simple and that there are a minimum of critical dimensions. The simplicity of engaging a sleeve 80 within a base 66 to define the passageway 96 means that the structure can be disassembled and put in a dishwasher to clean it. This is a very important consideration for domestic use.

In use, the assembly will of course be completed with liquid in the container 50. The container is first opened and held in an upright position with the neck uppermost and the sub-assembly of the base 66 and sleeve 80 engaged in an inverted position. Once the engagement is complete, the dispenser is then rotated into position shown in FIG. 4 and is ready for use. The first dispensing may have a slow response time, but once the liquid has established its levels, then the response will be very quick and a small movement of the end 52 to deflect the bellows 54 will result in dispensing. As mentioned with reference to FIGS. 1 to 3, the structure then defines a reservoir 28 having a level 42 of liquid and the operation is as described with reference to FIGS. 1 to 3.

Although the invention has been described with reference to a preferred embodiment, other embodiments are within the scope of the invention. In general, the establishment of a liquid level in a dispenser as illustrated in FIG. 1 is the first step and this can be disturbed by any pressure fluctuation within the dispenser. For instance, if pressure were applied to the space in the reservoir above the level 42, then this would cause dispensing. Similarly, if pressure were applied to the reservoir itself by deforming the reservoir then this would also result in dispensing. In other words, any arrangement whereby a change in the internal pressure results in a loss of negative pressure in the space 34 above the liquid will cause liquid to move towards the outlet 38 and dispense from the structure.

Such embodiments are within the scope of the invention as claimed.

I claim:

1. In a dispenser for liquids comprising:

a container for liquid, the container being closed above the liquid to develop a negative pressure due to the force of gravity on the liquid so that the liquid level is normally above a predetermined level;

a reservoir coupled to the container and having a bottom access below the predetermined level for liquid from the container and extending upwardly, the reservoir defining a pressure relief opening;

an outlet passageway coupled to the container and in communication with the reservoir and terminating at an outlet positioned so that there is no flow through the outlet when the dispenser is not actuated, the reservoir providing space for liquid to accumulate to compensate for temperature changes in the container and the relief opening permitting equalization with atmospheric pressure during temperature compensation; and the outlet and relief opening being proportioned so that on actuating the dispenser by changing said negative pressure to a more positive pressure, liquid will flow through the outlet with minimal air flow through the relief opening, the improvement in which the reservoir and outlet passageway are defined by the combination of a cup-shaped base and a sleeve within the base.

2. A dispenser for liquids comprising:

a container for the liquid closed at the top end and having a bottom opening, the weight of the liquid causing negative pressure in a space above the liquid;

a base releasably sealed to the container with the bottom opening contained in the base;

a sleeve releasably positioned inside the base and defining with the base a passageway extending upwardly, and an outlet adjacent the upper extremity of the base, the sleeve being in sealing engagement with the base but for the passageway whereby pressure changes in the dispenser which cause the negative pressure to become less negative will cause liquid to run through the passageway and out of the dispenser.

3. A dispenser as claimed in claim 2 in which the sleeve and base have walls defining very small conical tapers for frictional and sealing engagement of the sleeve inside the base.

* * * * *